US008359818B2

(12) United States Patent
Liu et al.

(10) Patent No.: US 8,359,818 B2
(45) Date of Patent: Jan. 29, 2013

(54) LARGE TRANSFUSION FILING AND CORKING MACHINE

(75) Inventors: Zhen Liu, Changsha (CN); Huanghui Long, Changsha (CN); Pengcheng Li, Changsha (CN); Yue Tang, Changsha (CN); Jiuzhou Su, Changsha (CN)

(73) Assignee: Truking Technology Limited, Changsha, Hunan (CN)

( * ) Notice: Subject to any disclaimer, the term of this patent is extended or adjusted under 35 U.S.C. 154(b) by 271 days.

(21) Appl. No.: 12/811,377

(22) PCT Filed: Dec. 29, 2008

(86) PCT No.: PCT/CN2008/073839

§ 371 (c)(1),
(2), (4) Date: Jul. 1, 2010

(87) PCT Pub. No.: WO2009/140844

PCT Pub. Date: Nov. 26, 2009

(65) Prior Publication Data

US 2011/0005168 A1 Jan. 13, 2011

(30) Foreign Application Priority Data

May 19, 2008 (CN) ..... 2008 1 0031331

(51) Int. Cl.
*B67C 7/00* (2006.01)
*B65B 31/04* (2006.01)

(52) U.S. Cl. ..... 53/510; 53/282; 53/302; 53/319

(58) Field of Classification Search ..... 53/510, 53/281, 282, 302, 304, 319; *B67C 7/00*
See application file for complete search history.

(56) References Cited

U.S. PATENT DOCUMENTS

| | | | | | |
|---|---|---|---|---|---|
| 1,710,074 | A | * | 4/1929 | Saviano | 53/282 |
| 1,881,783 | A | * | 10/1932 | Mallinckrodt, Jr. et al. | 53/510 |
| 2,140,187 | A | * | 12/1938 | Kantor | 53/510 |
| 2,174,745 | A | * | 10/1939 | Hoffman et al. | 53/510 |
| 2,180,836 | A | * | 11/1939 | Risser | 53/304 |
| 3,516,455 | A | * | 6/1970 | Carter | 141/90 |
| 3,670,786 | A | * | 6/1972 | Levin et al. | 53/510 |
| 4,602,473 | A | * | 7/1986 | Hayashi et al. | 53/510 |
| 5,390,469 | A | * | 2/1995 | Shimizu et al. | 53/284.6 |
| 5,581,975 | A | * | 12/1996 | Trebbi et al. | 53/282 |
| 7,549,275 | B2 | * | 6/2009 | Monti | 53/284.5 |
| 2005/0028487 | A1 | * | 2/2005 | Winters et al. | 53/510 |
| 2007/0107384 | A1 | * | 5/2007 | Capelli et al. | 53/510 |

FOREIGN PATENT DOCUMENTS

| | | | |
|---|---|---|---|
| CN | 2597454 | Y * | 1/2004 |
| CN | 200967741 | Y * | 10/2007 |

(Continued)

*Primary Examiner* — Stephen F Gerrity
(74) *Attorney, Agent, or Firm* — Raymond Y. Chan; David and Raymond Patent Firm

(57) ABSTRACT

A large transfusion filling and corking machine includes a frame unit, an electric control unit, a bottle-in unit, a following and filling unit, a nitrogen-charging and corking unit, and a bottle-out transfer wheel unit. The bottle-in unit, the following and filling unit, the nitrogen-charging and corking unit, and the bottle-out transfer wheel unit are mounted on the frame unit and connected by turns. The nitrogen-charging and corking unit is connected with a cork-delivering unit. A nitrogen-precharging unit is arranged between the bottle-in unit and the following and filling unit, which is connected with the bottle-in unit through a bottle-in transfer wheel unit, and connected with the following and filling unit through a transitional transfer wheel unit.

19 Claims, 4 Drawing Sheets

FOREIGN PATENT DOCUMENTS

| | | | | |
|---|---|---|---|---|
| CN | 101274732 | A | * | 10/2008 |
| DE | 3740128 | A1 | * | 6/1989 |
| EP | 798263 | A1 | * | 10/1997 |
| JP | 2008155941 | A | * | 7/2008 |

* cited by examiner

LARGE TRANSFUSION FILING AND CORKING MACHINE

BACKGROUND OF THE PRESENT INVENTION

1. Field of Invention

The present invention relates to a packaging machinery of the field of pharmacy, food, and healthcare products, and more particularly to a large transfusion filling and corking machine.

2. Description of Related Arts

Most of the common transfusion filling and corking machine adapts the method of entering fillers into bottles while injecting inert gas, such as nitrogen, therein, and then compressing and pushing one or more corks into the opening of the bottles. This type of process may be able to satisfy the arts of filling large amount of transfusion. However, the current filling process of the transfusion easily reacting with the air via the oxidation reactions can not meet the requirement thereof. More specifically, normally there is no step of pre-entering nitrogen into the bottle before filling the transfusion thereinto. Some of the manufacturing process may pre-inject the nitrogen into the bottles from the top openings thereof in attempt to reduce the level of air in the bottles. However, the specific gravity of nitrogen is smaller then the air and the transfusion filling source is usually located at a higher position then the bottles for being filled, so that the amount of nitrogen gas filled into the bottles is limited. Therefore, there is still a great amount of residual air in each of the bottles. When filling the fillers of the transfusion process into the bottles, the fillers is reacting with the residual air in the bottle, so that the transfusion filling process can not meet the requirement of the residual air below 2 to 3%. Secondly, after filled the bottles with the fillers, the corks are compressed and pushed into the openings of the bottles without vacuuming and injecting nitrogen in the bottles. Therefore, the air remaining in the bottles oxidize with the fillers during the transfusion filling and corking process, so that the products of the fillers may be deteriorated shortly.

SUMMARY OF THE PRESENT INVENTION

The present invention is advantageous in that it provides a transfusion filling and corking machine, which is simple in structure and is able to achieve the low level of the residual air in the bottles during the large transfusion filling and corking process.

Additional advantages and features of the invention will become apparent from the description which follows, and may be realized by means of the instrumentalities and combinations particular point out in the appended claims.

According to the present invention, the foregoing and other objects and advantages are attained by a large transfusion filling and corking machine comprises a frame unit, an electric control unit, a bottle-in unit, a following and filling unit, a nitrogen-charging and corking unit, and a bottle-out transfer wheel unit, wherein the bottle-in unit, the following and filling unit, the nitrogen-charging and corking unit, and the bottle-out transfer wheel unit are orderly supported by the frame unit. The nitrogen-charging and corking unit is operatively linked to a cork-delivering unit. A nitrogen-precharging unit is operatively linked between the bottle-in unit and the following and filling unit. The nitrogen-precharging unit is operatively linked to the bottle-in unit through a bottle-in transfer wheel unit thereof. The nitrogen-precharging unit is operatively linked to the following and filling unit through a transitional transfer wheel unit.

The nitrogen-precharging unit comprises a transmitting shaft, wherein the transmitting shaft has a bottom end portion coupling with a transmitting gear and an upper end portion coupling with a bottle supporting panel. A precharging feed-wheel is coupled with the bottle supporting panel. A precharging fencing member is supported adjacent to the precharging feed-wheel. A directional guide shaft is coaxially coupled within the transmitting shaft. A height adjusting shaft is coaxially coupled within the directional guide shaft, wherein the bottom end portion of the directional guide shaft is coupled at an elevation assembly while the upper end portion of the directional guide shaft is coupled at an elevation cam. The elevation cam has a cam groove that a bearing is coupled therewithin via a connection panel. A bottle stopper seat is coupled with the connection panel. A vacuum adapter and a nitrogen gas adapter are provided at the bottle stopper seat, wherein the vacuum adapter and the nitrogen gas adapter are operatively connected to a vacuum distribution box and a nitrogen gas distribution box respectively.

The vacuum distribution box and the nitrogen gas distribution box are supported by a distribution shaft. A carbon brush is provided at an upper end portion of the distribution shaft. A main vacuum regulator and a main nitrogen gas regulator are coupled at the top end of the distribution shaft to operatively link with the vacuum distribution box and the nitrogen gas distribution box respectively. The vacuum adapter and the nitrogen gas adapter are operatively connected to the vacuum distribution box and the nitrogen gas distribution box through flexible tubes via a vacuum electromagnetic regulator and a nitrogen gas electromagnetic regulator respectively.

The nitrogen-charging and corking unit comprises a transmission shaft, wherein the bottom end portion of the transmission shaft is coupled with a transmission gear, an upper end portion of the transmission shaft is coupled with a bottle supporting panel. A nitrogen-charging and corking fence is supported and retained adjacent to the nitrogen-charging and corking feeding wheel. A directional shaft is coaxially coupled within the transmission shaft. A height adjustment shaft is coaxially coupled within the directional shaft, wherein a bottom end portion of the height adjustment shaft is coupled with an elevator assembly, while an upper end portion of the height adjustment shaft is coupled with an elevating cam. The elevating cam is coupled with a machinery arm and a sealing sleeve, wherein each of the machinery arm and the sealing sleeve has an elevating cam-groove. A first bearing is coupled with an upper connecting member within the elevating cam-groove of the sealing sleeve. A bottle cap seat is coupled with the upper connecting member. A bottle cap seat is coupled with the upper connecting member. A cam sleeve is rotatably coupled on top of the bottle cap seat. The sealing sleeve is coupled with the cam sleeve via a pressuring sleeve. A vacuum adapter head is coupled with the bottle cap seat to operatively link with a vacuum distributing box. A nitrogen gas adapter head is coupled with the cam sleeve to operatively link with a nitrogen gas distributing box.

A second bearing is coupled with a lower connecting member within the elevating cam-groove of the machinery arm, wherein the lower connecting member is coupled with an elevation shaft. The machinery arm is operatively coupled at the bottom end portion of the elevation shaft. A vacuum corking adapter head is operatively coupled at an upper end portion of the elevation shaft, wherein the vacuum corking adapter head is operatively linked to a vacuum corking electromagnetic valve via a flexible tube. Another outlet of the vacuum corking electromagnetic valve is operatively linked to the vacuum distributing box via another flexible tube.

The following and filling unit comprises a swing arm shaft retained at a base panel, wherein a swing arm is operatively coupled with the swing arm shaft and is operatively coupled with a following cam. A cam shaft is coupled at the following cam. One end of connection arm is coupled with the swing arm via a swing shaft. Another end of the connection arm is coupled with a directional guiding shaft to drive the directional guiding shaft to move at a swinging manner. The directional guiding shaft is supported within a hollow shaft. The hollow shaft has a bottom portion coupling with a gear wheel and an upper portion coupling with the following and filling feed-wheel. A filling frame is coupled at an upper portion of the directional guiding shaft, wherein a filling head and a gas distributing box are coupled at the filling frame. The filling head is operatively linked to the gas distributing box via a flexible tube.

The bottle-in unit, which is operatively linked to a bottle transferring unit, comprises a bottle-in gear unit. The bottle transferring unit comprises an endless conveying belt and two fencing elements supported at two sides of the endless conveying belt. The outlet end of the bottle transferring unit is connected to the inlet end of the bottle-in gear unit. The bottle-in gear unit comprises a worm gear having an outer spiral threaded portion and defining a plurality of feeding indentions thereat, wherein the outer surfaces of the bottles are orderly guided at the feeding indentions in a sequent manner when the worm gear is driven to rotate. The outlet end of the bottle-in transfer gear unit is operatively linked with an inlet end of the bottle-in transfer wheel unit.

The present invention has the following advantages compared to the existing arts. The present invention is simple in structure, wherein the main production arts are nitrogen pre-injection, simultaneously bottling and injecting nitrogen gas, and vacuuming and nitrogen injecting and corking process. The nitrogen pre-injecting or pre-filling is vacuuming and filling the nitrogen three times of the sealed bottle in an alternating to manner, so that the air within the bottle is able to replace with the nitrogen gas, so as to minimize the oxidation reaction between the air and the fillers. The nitrogen is injecting into the bottles during the bottle filling process, so as to protect the bottling process from reacting with air. During the corking process, the corks are placed at each of openings of the bottles via a machinery arm, then lower the corks for sealing the bottles, and then vacuuming and injecting nitrogen at least three times in an alternating manner for replacing the air therein. The corks are slightly lifted at a predetermined distance for discharging the pressure in the bottles, and then compressing and pushing the corks into the openings of the bottle under a substantially sealed status of the bottles for corking. Therefore, the residual air in the bottles is insignificant and being minimized, so as to ensure the stability of the fillers in the bottles. The present invention is suitable for chemically unstable fillers of the transfusion products or high added value of the fillers.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
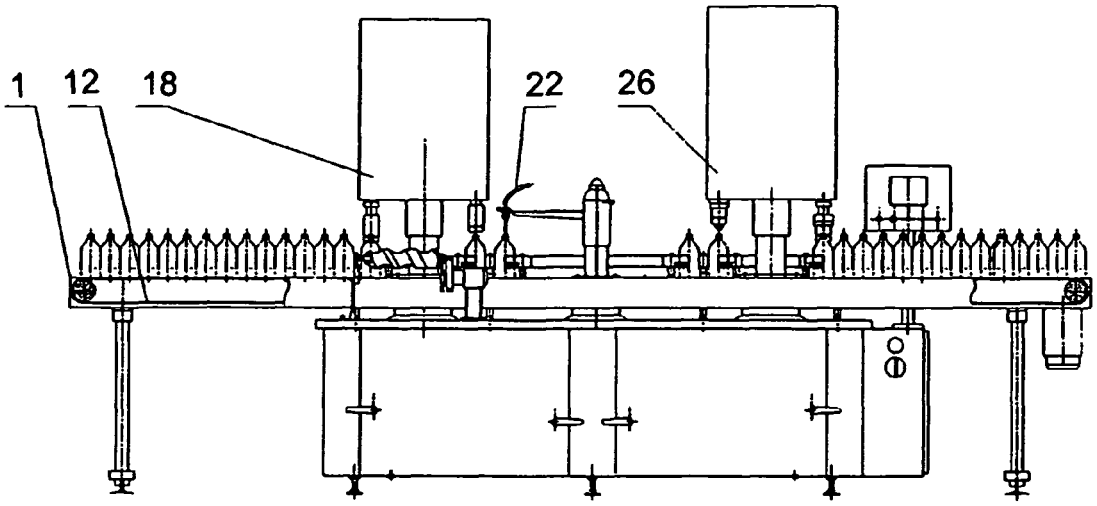
FIG. 1 is a schematic view of a large transfusion filling and corking machine according to a preferred embodiment of the present invention.
Figure 2:
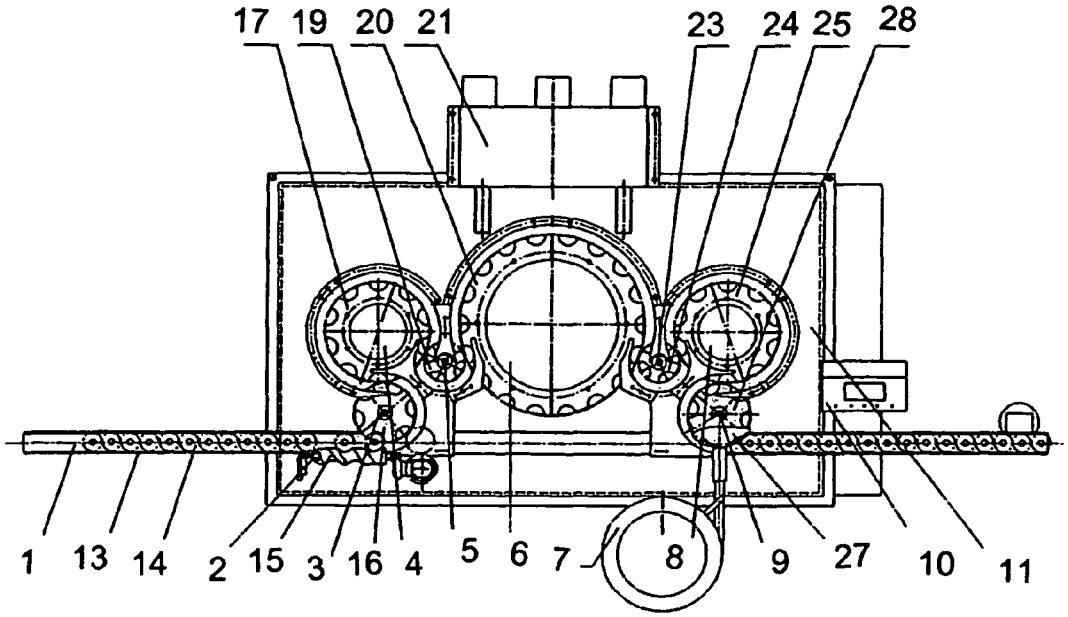
FIG. 2 is a top view of the large transfusion filling and corking machine according to the above preferred embodiment of the present invention.

As shown in FIGS. 1 and 2, a large transfusion filling and corking machine comprises a frame unit 11, a bottle transferring unit 1 supported by the frame unit 11, a bottle-in transfer gear unit 2, a bottle-in transfer wheel unit 3, a nitrogen-precharging unit 4, a transitional transfer wheel unit 5, a following and filling unit 6, a cork-delivering unit 7, a nitrogen-charging and corking unit 8, a bottle-out transfer wheel unit 9, and an electric control unit 10 for operatively controlling the above units. Accordingly, the bottle-in transfer gear unit 2 and the bottle-in transfer wheel unit 3 form a bottle-in unit. According to the preferred embodiment, the bottle transferring unit 1, which is an endless belt transferring assembly, comprises an endless conveying belt 12 and two fencing elements 13 supported at two parallel sides of the endless conveying belt 12, wherein a distance between the fencing elements 13 matches with a diameter of the bottle 14. Accordingly, the bottles 14 are orderly aligned side-by-side in a row along the endless conveying belt 12. When the endless conveying belt 12 is actuated, the bottles 14 are orderly fed forward by the friction between the endless conveying belt 12 and the bottom sides of the bottles 14. The front outlet end of the bottle transferring unit 1 is connected to the inlet end of the bottle-in gear unit 2. In particular, the bottle-in gear unit 2 is located aside at the front outlet end of the bottle transferring unit 1. The bottle-in gear unit 2 comprises a worm gear 15 having an outer spiral threaded portion and defining a plurality of feeding indentions thereat, wherein the outer surfaces of the bottles 14 are orderly guided at the feeding indentions in a sequent manner when the worm gear 15 is driven to rotate. Accordingly, the feeding indention at the front end of the worm gear 15 is aligned with one of the fencing elements 13 at the front outlet end of the bottle transferring unit 1. Therefore, when the worm gear 15 is driven to rotate, the bottles 14 are orderly transferred in a forward direction with respect to the feeding indentions. The bottle-in transfer wheel unit 3 comprises a bottle-in feed-wheel 16 having a plurality of arc-shaped feeding slots provided at a peripheral edge of the bottle-in feed-wheel 16. The outlet end of the bottle-in transfer gear unit 2 is operatively linked with an inlet end of the bottle-in transfer wheel unit 3. When the worm gear 15 is rotated at a predetermined position the front end feeding indention of the worm gear 15 is aligned with one of the feeding slots of the bottle-in feed-wheel 16, such that the corresponding bottle 14 can be transferred from the worm gear 15 to the bottle-in feed-wheel 16 and can then be further transferred by the bottle-in feed-wheel 16 by the rotation of the bottle-feed-wheel 16. The nitrogen-precharging unit 4 is positioned between the bottle-in transfer wheel unit 3 and the transitional transfer wheel unit 5, wherein the inlet end of the precharging unit 4 is alignedly and operatively linked to the outlet end of the bottle-in transfer wheel unit 3 while the outlet end of the precharging unit 4 is alignedly and operatively linked to the inlet end of the transitional transfer wheel unit 5. In other words, the bottles 14 are transferred from the bottle-in feed-wheel 16 to the slots of a precharging feed-wheel 17 of the precharging unit 4. A precharging assembly 18 is positioned at a front side of the precharging feed-wheel 17 is arranged to drop down to seal the respective bottle 14. Then, the precharging assembly 18 will vacuum the interior of the bottle 14 and charge the nitrogen gas thereinto for three sequent cycles in a pulsation replacement manner. After the precharge of the nitrogen gas, the precharging assembly 18 is lifted up, such that the precharged bottle 14 will then be transferred from the precharging feed-wheel 17 to the slot of a transitional feed-wheel 19 of the transitional transfer wheel unit 5. The following and filling unit 6 is positioned between the two transitional transfer wheel units 5, 23, i.e. the first transitional transfer wheel unit 5 and the second transitional transfer wheel unit 23. The outlet end of the first transitional transfer wheel unit 5 is operatively linked to the inlet end of the following and filling unit 6 while the outlet end of the following and filling unit 6 is operatively linked to the inlet end of the second transitional transfer wheel unit 23. Therefore, the bottles 14 are orderly transferred from the transitional feed-wheel 19 of the first transitional transfer wheel unit 5 to a following and filling feed-wheel 20 of the following and filling unit 6. A peristaltic pump 21 is operatively connected to the following and filling unit 6 via a flexible tube 22. The bottles 14 are then orderly transferred from the following and filling feed-wheel 20 of the following and filling unit 6 to a transitional feed-wheel 24 of the second transitional transfer wheel unit 23. The nitrogen-charging and corking unit 8 is positioned between the second transitional transfer wheel unit 23 and the bottle-out transfer wheel unit 9, wherein the inlet end of the nitrogen-charging and corking unit 8 is operatively linked to the outlet end of the second transitional transfer wheel unit 23 while the outlet end of the nitrogen-charging and corking unit 8 is operatively linked to the inlet end of the bottle-out transfer wheel unit 9. The bottles 14 are transferred from the transitional feed-wheel 24 of the second transitional transfer wheel unit 23 to a nitrogen-charging and corking feed-wheel 25 of the nitrogen-charging and corking unit 8. A nitrogen-charging and corking assembly 26 is positioned above the nitrogen-charging and corking feed-wheel 25, wherein the nitrogen-charging and corking assembly 26 receives a bottle cork from a cork delivering base 27. The nitrogen-charging and corking assembly 26 is dropped down to seal the respective bottle 14. Then, the nitrogen-charging and corking assembly 26 will vacuum the interior of the bottle 14 and charge the nitrogen gas thereinto for three sequent cycles in a pulsation replacement manner. The nitrogen-charging and corking assembly 26 will then cork the bottle cork at the opening of the bottle to seal the bottle. The bottle 14 charged with nitrogen gas is transferred to a bottle-out feed-wheel 28 of the bottle-out transfer wheel unit 9. Accordingly, the cork delivering base 27 is positioned right above the bottle-out feed-wheel 28, wherein the cork-delivering unit 7 is positioned right in front of the cork delivering base 27 to directly deliver the bottle cork to the cork delivering base 27. Lastly, the corked bottle 14 charged with nitrogen gas is transferred from the bottle-out feed-wheel 28 of the bottle-out transfer wheel unit 9 back to the endless conveying belt 12 of the bottle transferring unit 1 for next procedure.

Figure 3:
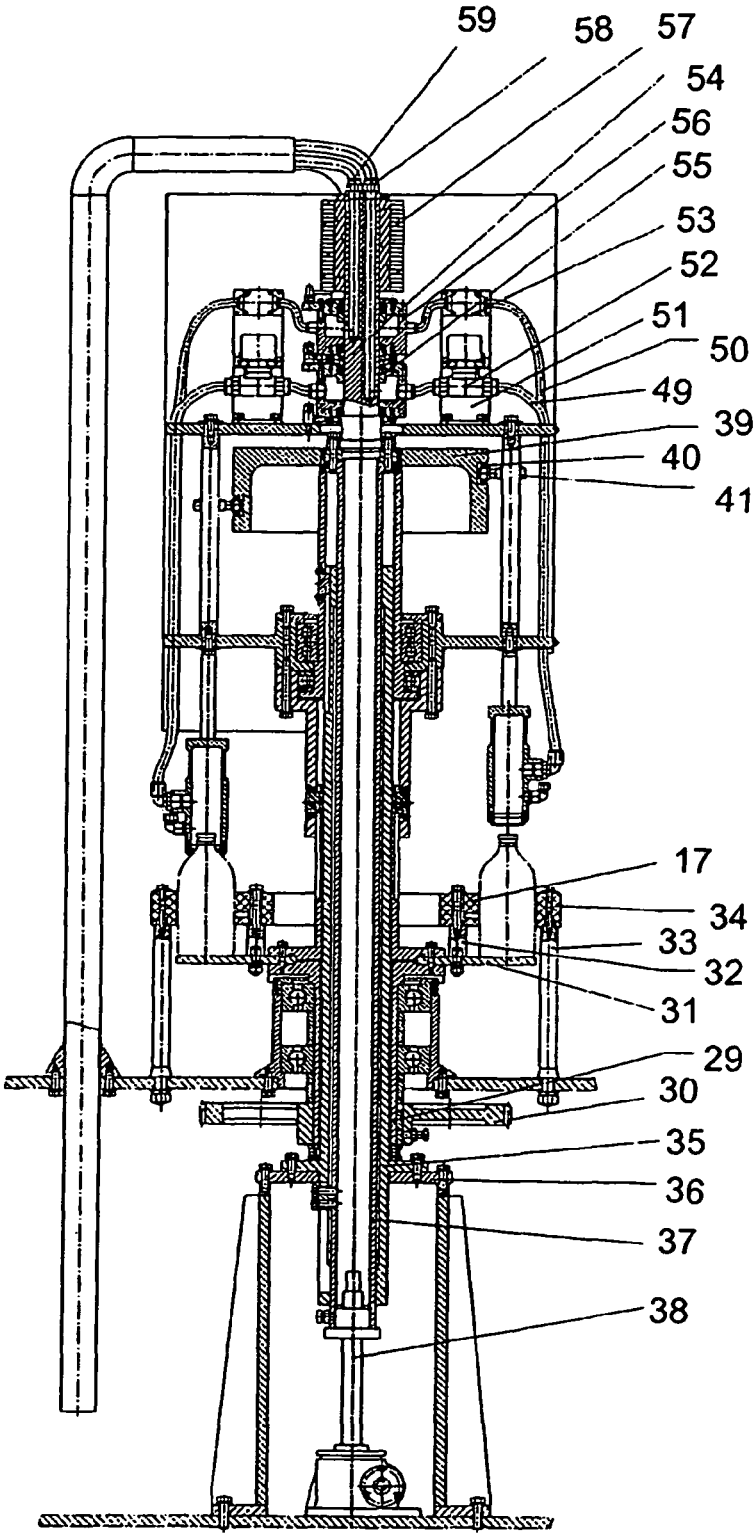
FIG. 3 is a schematic view of a nitrogen-precharging unit of the large transfusion filling and corking machine according to the above preferred embodiment of the present invention.
Figure 4:
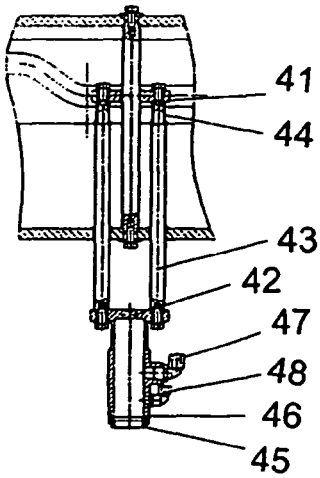
FIG. 4 is a schematic view of a bottle stopper seat of the nitrogen-precharging unit of the large transfusion filling and corking machine according to the above preferred embodiment of the present invention.

As shown in FIGS. 3 and 4, the nitrogen-precharging unit 4 comprises a transmitting shaft 29, wherein the transmitting shaft 29 has a bottom end portion coupling with a transmitting gear 30 and an upper end portion coupling with a bottle supporting panel 31. A precharging feed-wheel 17 is coupled with the bottle supporting panel 31 via a first support member 32. A precharging fencing member 34 is supported adjacent to the precharging feed-wheel 17 via a second support member 33. A directional guide shaft 35 is coaxially coupled within the transmitting shaft 29, wherein a bottom end portion of the directional guide shaft 35 is coupled at a support base 36. A height adjusting shaft 37 is coaxially coupled within the directional guide shaft 35, wherein the bottom end portion of the directional guide shaft 35 is coupled at an elevation assembly 38 while the upper end portion of the directional guide shaft 35 is coupled at an elevation cam 39. The elevation cam 39 has a cam groove that a bearing 40 is coupled therewithin via a connection panel 41. A bottle stopper seat 42 is coupled with the connection panel 41 via two support arms 43. A buffering spring 44 is coupled at an upper end portion of each of the support arms 43. A sealed sleeve 45 is coupled with the bottle stopper seat 42 via a pressurized sleeve 46. A vacuum adapter 47 and a nitrogen gas adapter 48 are provided at the bottle stopper seat 42, wherein the vacuum adapter 47 and the nitrogen gas adapter 48 are operatively connected to a vacuum electromagnetic regulator 52 and a nitrogen gas electromagnetic regulator 53 via two flexible tubes 83, 84 respectively. The vacuum electromagnetic regulator 52 and the nitrogen gas electromagnetic regulator 53 are supported by an installing panel 51. A vacuum distribution box 55 and a nitrogen gas distribution box 56 are connected to other outlets of the vacuum electromagnetic regulator 52 and the nitrogen gas electromagnetic regulator 53 via another two flexible tubes respectively, wherein the vacuum distribution box 55 and a nitrogen gas distribution box 56 are supported by a distribution shaft 54. A carbon brush 57 is provided at an upper end portion of the distribution shaft 54. A main vacuum regulator 58 and a main nitrogen gas regulator 59 are coupled at the top end of the distribution shaft 54 to operatively link with the vacuum distribution box 55 and a nitrogen gas distribution box 56 respectively.

Figure 5:
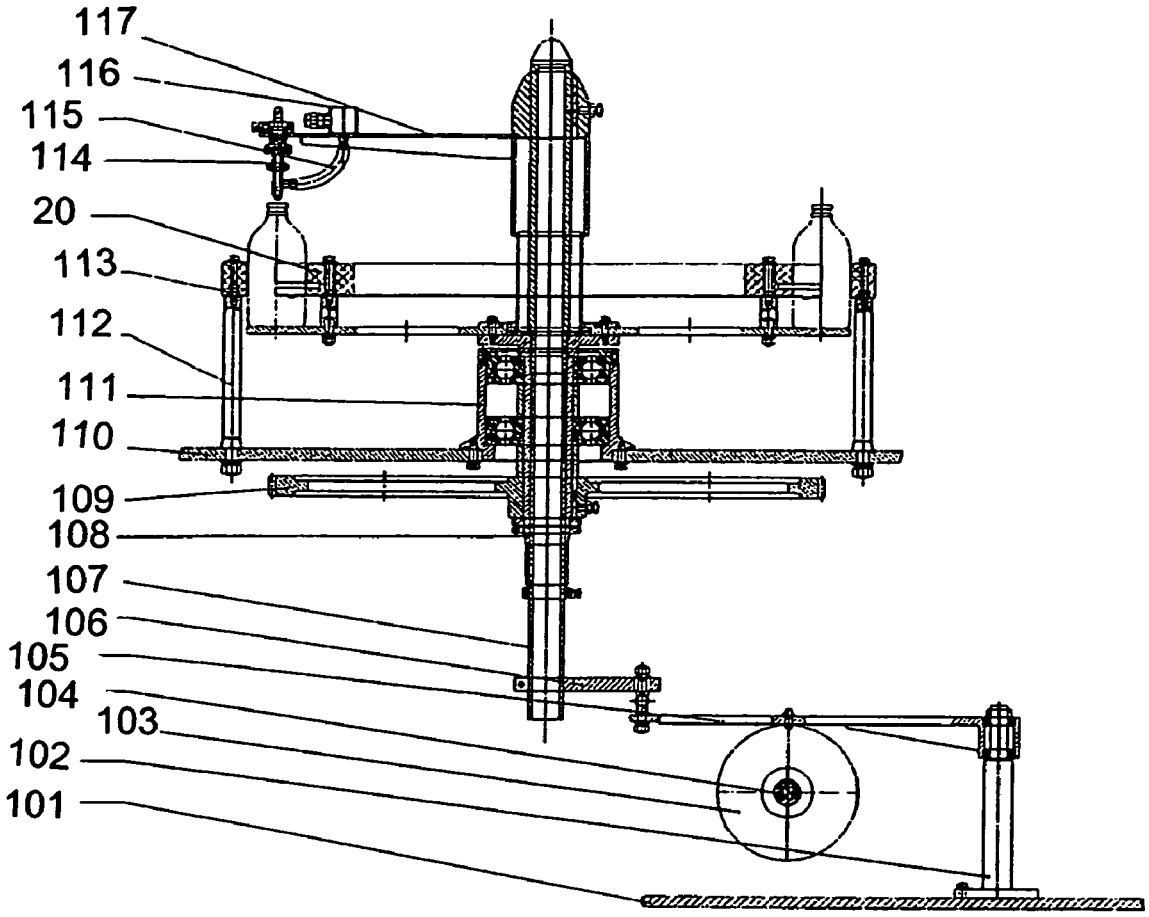
FIG. 5 is a schematic view of a following and filling unit of the large transfusion filling and corking machine according to the above preferred embodiment of the present invention.
Figure 6:
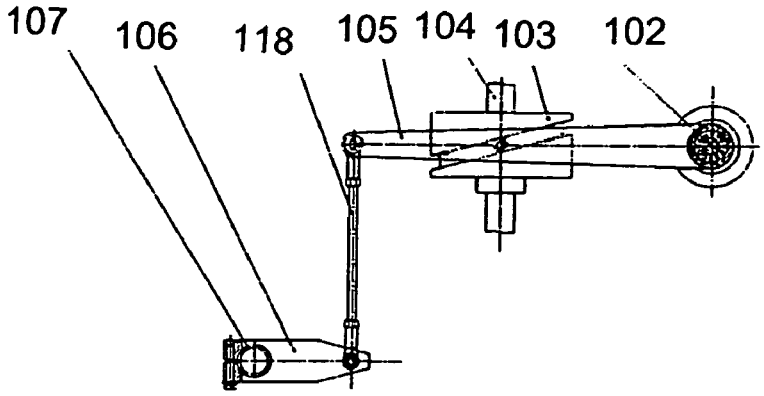
FIG. 6 is a partially schematic view of the following and filling unit of the large transfusion filling and corking machine according to the above preferred embodiment of the present invention.

As shown in FIGS. 5 and 6, the following and filling unit 6 is arranged for keep tracking the movement of a filling head 114. A swing arm shaft 102 is retained at a base panel 101, wherein a swing arm 105 is operatively coupled with the swing arm shaft 102 and is operatively coupled with a following cam 103. A cam shaft 104 is coupled at the following cam 103. One end of connection arm 106 is coupled with the swing arm 105 via a swing shaft 118. Another end of the connection arm 106 is coupled with a directional guiding shaft 107 to drive the directional guiding shaft 107 to move at a swinging manner. The directional guiding shaft 107 is supported within a hollow shaft 108, wherein the hollow shaft 108 is extended through a support panel 110 and is retained at the support panel 110 via retention seat 111. The hollow shaft 108 has a bottom portion coupling with a gear wheel 109 and an upper portion coupling with the following and filling feed-wheel 20. A fencing member 113 is mounted at the support panel 110 via a retention arm 112, wherein the fencing member 113 is positioned adjacent to the filling feed-wheel 20. A filling frame 117 is coupled at an upper portion of the directional guiding shaft 107, wherein a filling head 114 and a gas distributing box 116 are operatively coupled at the filling frame 117. The filling head 114 is operatively linked to the gas distributing box 116 via a flexible tube 115.

Figure 7:
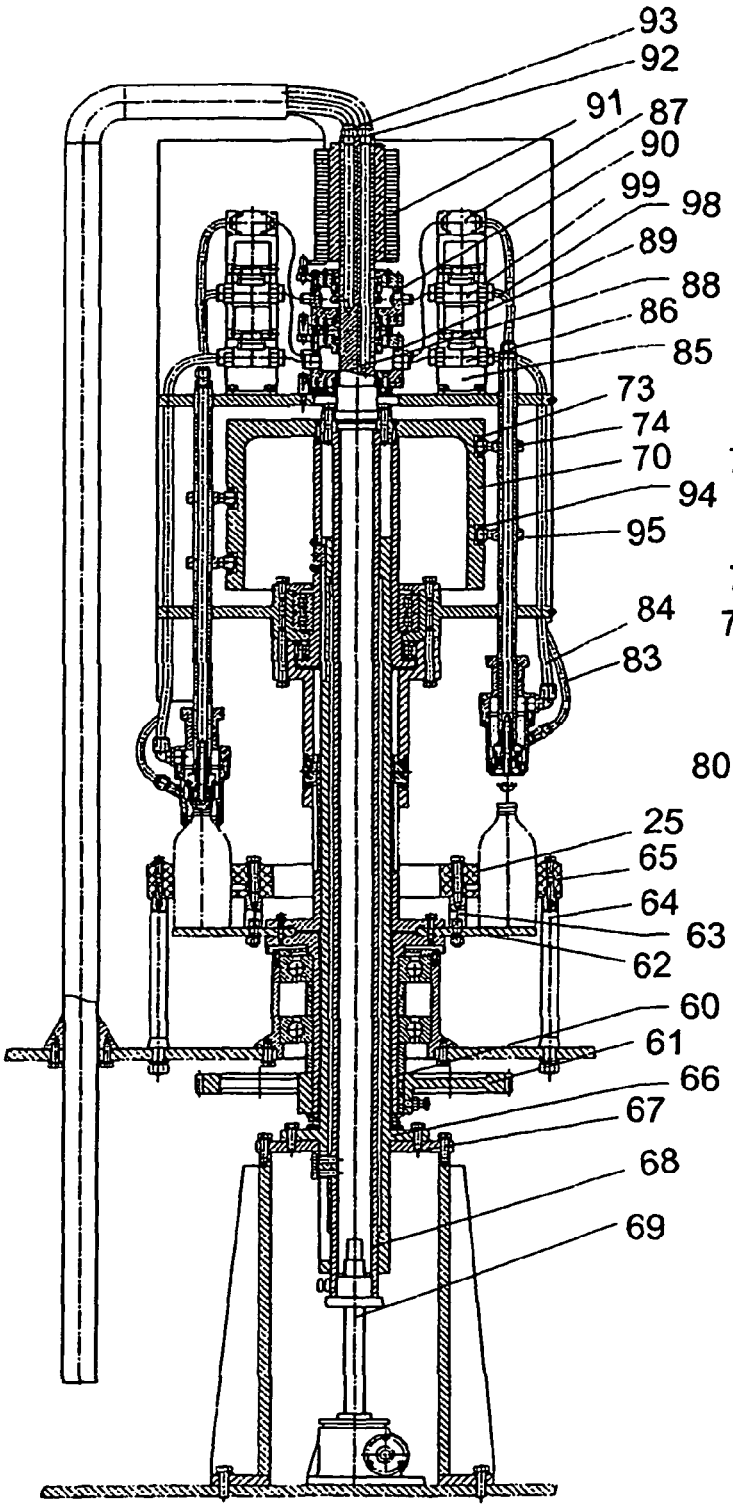
FIG. 7 is a schematic view of a nitrogen-charging and corking unit of the large transfusion filling and corking machine according to the above preferred embodiment of the present invention.
Figure 8:
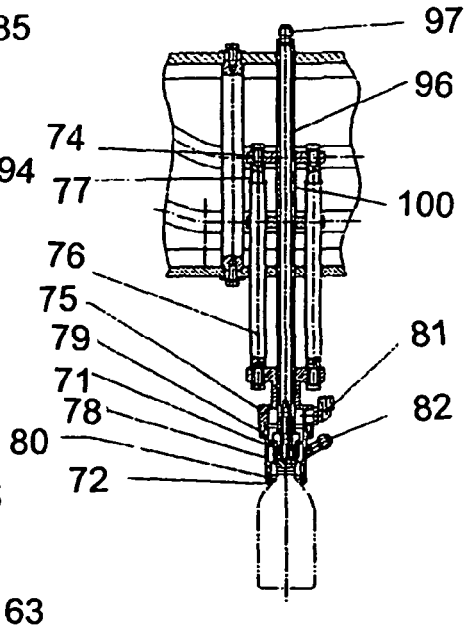
FIG. 8 is a partially schematic view of the nitrogen-charging and corking unit of the large transfusion filling and corking machine according to the above preferred embodiment of the present invention.

As shown in FIGS. 7 and 8, the nitrogen-charging and corking unit 8 comprises a transmission shaft 60, wherein the bottom end portion of the transmission shaft 60 is coupled with a transmission gear 61, an upper end portion of the transmission shaft 60 is coupled with a bottle supporting panel 62. The nitrogen-charging and corking feeding wheel 25 is supported and retained on top of the bottle supporting panel 62 via one of more first supporting members 63. A nitrogen-charging and corking fence 65 is supported and retained adjacent to the nitrogen-charging and corking feeding wheel 25 via one or more second supporting members 64. A directional shaft 66 is coaxially coupled within the transmission shaft 60, wherein a bottom end portion of the directional shaft 66 is coupled with a supportive retention base 67. A height adjustment shaft 68 is coaxially coupled within the directional shaft 66, wherein a bottom end portion of the height adjustment shaft 68 is coupled with an elevator assembly 69, while an upper end portion of the height adjustment shaft 68 is coupled with an elevating cam 70. The elevating cam 70 is coupled with a machinery arm 71 and a sealing sleeve 72, wherein each of the machinery arm 71 and a sealing sleeve 72 has an elevating cam-groove. A first bearing 73 is coupled with an upper connecting member 74 within the elevating cam-groove of the sealing sleeve 72. A bottle cap seat 75 is coupled with the upper connecting member 74 via two supporting arms 76. A buffering spring 77 is coupled at an upper end portion of each of the supporting arms 76. A cam sleeve 78 is rotatably coupled on top of the bottle cap seat 75 via a threaded sleeve 79. The sealing sleeve 70 is coupled with the cam sleeve 78 via a pressuring sleeve 80. A vacuum adapter head 81 is coupled with the bottle cap seat 75. A nitrogen gas adapter head 82 is coupled with the cam sleeve 78. The vacuum adapter head 81 and the nitrogen gas adapter head 82 are operatively connected to a vacuum electromagnetic valve 86 and a nitrogen gas electromagnetic valve 87 via two flexible tubes 83, 84 respectively, wherein the vacuum electromagnetic valve 86 and the nitrogen gas electromagnetic valve 87 are supported by an installation panel 85. A vacuum distributing box 89 and a nitrogen gas distributing box 90 are connected to other outlets of the vacuum electromagnetic valve 86 and the nitrogen gas electromagnetic valve 87 via another two flexible tubes respectively, wherein the vacuum distributing box 89 and a nitrogen gas distributing box 90 are supported by a distributing shaft 88. A carbon brush 91 is provided at an upper end portion of the distributing shaft 88. A main vacuum adapter 92 and a main nitrogen gas adapter 93 are coupled at the top end of the distributing shaft 88 to operatively link with the vacuum distributing box 89 and a nitrogen gas distributing box 90 respectively. A second bearing 94 is coupled with a lower connecting member 95 within the elevating cam-groove of the machinery arm 71, wherein the lower connecting member 95 is coupled with an elevation shaft 96. The machinery arm 71 is operatively coupled at the bottom end portion of the elevation shaft 96. A vacuum corking adapter head 97 is operatively coupled at an upper end portion of the elevation shaft 96, wherein the vacuum corking adapter head 97 is operatively linked to a vacuum corking electromagnetic valve 99 via another flexible tube 98. The vacuum corking electromagnetic valve 99 is supported by the installation panel 85. Another outlet of the vacuum corking electromagnetic valve 99 is operatively linked to the vacuum distributing box 89 via another flexible tube. A buffering spring 100 is provided between the upper and lower connecting members 74, 95.

The filling and corking operation of the present invention is illustrated as follows. The bottles 14 are firstly fed at the endless conveying belt 12 of the bottle transferring unit 1 manually or by bottle feeding machine, wherein the bottles 14 will be automatically transferred along the endless conveying belt 12 by the friction between the endless conveying belt 12 and the bottom sides of the bottles 14. The bottles 14 are orderly transferred at the endless conveying belt 12 in a row via the fencing elements 13 to the feeding indentions of the worm gear 15 of the bottle-in gear unit 2. When the worm gear 15 is driven to rotate, the bottles 14 are spacedly separated through the distance between the feeding indentions and are transferred at a constant transferring speed, so as to transfer the bottles 14 to the feeding slots of the bottle-in feed-wheel 16 of the bottle-in transfer wheel unit 3. When the bottle-in feed-wheel 16 is rotated, the bottles 14 are transferred to the slots of the precharging feed-wheel 17 of the precharging unit 4. The precharging assembly 18 at the front side of the precharging feed-wheel 17 will to drop down to seal the respective bottle 14. Then, the precharging assembly 18 will vacuum the interior of the bottle 14 and charge the nitrogen gas thereinto for three sequent cycles in an alternating manner. After the precharge of the nitrogen gas, the precharging assembly 18 is lifted up, wherein the precharged bottle 14 will then be transferred from the precharging feed-wheel 17 to the slot of a transitional feed-wheel 19 of the transitional transfer wheel unit 5. During the rotation of the transitional feed-wheel 19, the bottles 14 are orderly transferred from the transitional feed-wheel 19 of the first transitional transfer wheel unit 5 to the following and filling feed-wheel 20 of the following and filling unit 6. Accordingly, the following and filling feed-wheel 20 is rotated at one direction and at a constant rotational speed to transfer the bottles 14 at a filling position. The peristaltic pump 21 will inject the liquid into the bottle 14. After the liquid is filled into the bottle 14, the filling head 114 will automatically and rapidly moved back to its original position. The bottles 14 are transferred from the following and filling feed-wheel 20 to the transitional feed-wheel 24 of the second transitional transfer wheel unit 23. The second transitional transfer wheel unit 23 is rotated to transfer the bottles 14 to the nitrogen-charging and corking feed-wheel 25 of the nitrogen-charging and corking unit 8. The nitrogen-charging and corking assembly 26 receives a bottle cork from a cork delivering base 27. The nitrogen-charging and corking assembly 26 is dropped down to seal the respective bottle 14. Then, the nitrogen-charging and corking assembly 26 will vacuum the interior of the bottle 14 and charge the nitrogen gas thereinto for three sequent cycles in a pulsation replacement manner. The nitrogen-charging and corking assembly 26 will then cork the bottle cork at the opening of the bottle to seal the bottle. The nitrogen-charging and corking feed-wheel 25 will transfer the bottles 14 to the bottle-out feed-wheel 28 of the bottle-out transfer wheel unit 9. During the rotation of the bottle-out feed-wheel 28, the corked bottle 14 charged with nitrogen gas is transferred from the bottle-out feed-wheel 28 of the bottle-out transfer wheel unit 9 back to the endless conveying belt 12 of the bottle transferring unit 1 for next procedure.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A large transfusion filling and corking machine, comprising a frame unit, an electric control unit, a bottle-in unit, a following and filling unit, a nitrogen-charging and corking unit, and a bottle-out transfer wheel unit, wherein said bottle-in unit, said following and filling unit, said nitrogen-charging and corking unit, and said bottle-out transfer wheel unit are orderly supported by said frame unit, wherein said nitrogen-charging and corking unit is operatively linked to a cork-delivering unit, wherein a nitrogen-precharging unit is operatively linked between said bottle-in unit and said following and filling unit, wherein said nitrogen-precharging unit is operatively linked to said bottle-in unit through a bottle-in transfer wheel unit thereof, wherein said nitrogen-precharging unit is operatively linked to said following and filling unit through a transitional transfer wheel unit, wherein said nitrogen-precharging unit comprises a transmitting shaft, wherein said transmitting shaft has a bottom end portion coupling with a transmitting gear and an upper end portion coupling with a bottle supporting panel, wherein a precharging feed-wheel is coupled with said bottle supporting panel, wherein a precharging fencing member is supported adjacent to said precharging feed-wheel, wherein a directional guide shaft is coaxially coupled within said transmitting shaft, wherein a height adjusting shaft is coaxially coupled within said directional guide shaft, wherein a bottom end portion of said directional guide shaft is coupled at an elevation assembly while an upper end portion of said directional guide shaft is coupled at an elevation cam, wherein said elevation cam has a cam groove that a bearing is coupled therewithin via a connection panel, wherein a bottle stopper seat is coupled with said connection panel, wherein a vacuum adapter and a nitrogen gas adapter are provided at said bottle stopper seat, wherein said vacuum adapter and said nitrogen gas adapter are operatively connected to a vacuum distribution box and a nitrogen gas distribution box respectively.

2. The large transfusion filling and corking machine, as recited in claim 1, wherein said vacuum distribution box and said nitrogen gas distribution box are supported by a distribution shaft, wherein a carbon brush is provided at an upper end portion of said distribution shaft, wherein a main vacuum regulator and a main nitrogen gas regulator are coupled at a top end of the distribution shaft to operatively link with said vacuum distribution box and said nitrogen gas distribution box respectively, wherein said vacuum adapter and the nitrogen gas adapter are operatively connected to said vacuum distribution box and said nitrogen gas distribution box through flexible tubes via a vacuum electromagnetic regulator and a nitrogen gas electromagnetic regulator respectively.

3. The large transfusion filling and corking machine, as in claim 2, wherein said following and filling unit comprises a swing arm shaft retained at a base panel, wherein a swing arm is operatively coupled with said swing arm shaft and is operatively coupled with a following cam, wherein a cam shaft is coupled at said following cam, wherein one end of a connection arm is coupled with said swing arm via a swing shaft while another end of said connection arm is coupled with a directional guiding shaft to drive said directional guiding shaft to move at a swinging manner, wherein said directional guiding shaft is supported within a hollow shaft, wherein said hollow shaft has a bottom portion coupling with a gear wheel and an upper portion coupling with a following and filling feed-wheel, wherein a filling frame is coupled at an upper portion of said directional guiding shaft, wherein a filling head and a gas distributing box are coupled at said filling frame, wherein said filling head is operatively linked to said gas distributing box via a flexible tube.

4. The large transfusion filling and corking machine, as recited in claim 3, wherein said bottle-in unit, which is operatively linked to a bottle transferring unit, comprises a bottle-in gear unit, wherein said bottle transferring unit comprises an endless conveying belt and two fencing elements supported at two sides of said endless conveying belt, wherein an outlet end of said bottle transferring unit is connected to an inlet end of said bottle-in gear unit, wherein said bottle-in gear unit comprises a worm gear having an outer spiral threaded portion and defining a plurality of feeding indentions thereat for orderly guiding outer surfaces of bottles at said feeding indentions in a sequent manner when said worm gear is driven to rotate, wherein an outlet end of said bottle-in transfer gear unit is operatively linked with an inlet end of said bottle-in transfer wheel unit.

5. The large transfusion filling and corking machine, as in claim 2, wherein said nitrogen-charging and corking unit comprises a transmission shaft, wherein a bottom end portion of said transmission shaft is coupled with a transmission gear, while an upper end portion of said transmission shaft is coupled with a bottle supporting panel, wherein a nitrogen-charging and corking fence is supported and retained adjacent to said nitrogen-charging and corking feeding wheel, wherein a directional shaft is coaxially coupled within said transmission shaft, wherein a height adjustment shaft is coaxially coupled within said directional shaft, wherein a bottom end portion of said height adjustment shaft is coupled with an elevator assembly, while an upper end portion of said height adjustment shaft is coupled with an elevating cam, wherein said elevating cam is coupled with a machinery arm and a sealing sleeve, wherein each of said machinery arm and said sealing sleeve has an elevating cam-groove, wherein a first bearing is coupled with an upper connecting member within said elevating cam-groove of said sealing sleeve, wherein a bottle cap seat is coupled with said upper connecting member, wherein a cam sleeve is rotatably coupled on top of said bottle cap seat, wherein said sealing sleeve is coupled with said cam sleeve via a pressuring sleeve, wherein a vacuum adapter head is coupled with said bottle cap seat to operatively link with a vacuum distributing box, wherein a nitrogen gas adapter head is coupled with said cam sleeve to operatively link with a nitrogen gas distributing box.

6. The large transfusion filling and corking machine, as recited in claim 5, wherein a second bearing is coupled with a lower connecting member within said elevating cam-groove of said machinery arm, wherein said lower connecting member is coupled with an elevation shaft, wherein said machinery arm is operatively coupled at a bottom end portion of said elevation shaft, wherein a vacuum corking adapter head is operatively coupled at an upper end portion of said elevation shaft, wherein said vacuum corking adapter head is operatively linked to a vacuum corking electromagnetic valve via a flexible tube, wherein another outlet of said vacuum corking electromagnetic valve is operatively linked to said vacuum distributing box via another flexible tube.

7. The large transfusion filling and corking machine, as recited in claim 6, wherein said bottle-in unit, which is operatively linked to a bottle transferring unit, comprises a bottle-in gear unit, wherein said bottle transferring unit comprises an endless conveying belt and two fencing elements supported at two sides of said endless conveying belt, wherein an outlet end of said bottle transferring unit is connected to an inlet end of said bottle-in gear unit, wherein said bottle-in gear unit comprises a worm gear having an outer spiral threaded portion and defining a plurality of feeding indentions thereat for orderly guiding outer surfaces of bottles at said feeding indentions in a sequent manner when said worm gear is driven to rotate, wherein an outlet end of said bottle-in transfer gear unit is operatively linked with an inlet end of said bottle-in transfer wheel unit.

8. The large transfusion filling and corking machine, as in claim 2, wherein said bottle-in unit, which is operatively linked to a bottle transferring unit, comprises a bottle-in gear unit, wherein said bottle transferring unit comprises an endless conveying belt and two fencing elements supported at two sides of said endless conveying belt, wherein an outlet end of said bottle transferring unit is connected to an inlet end of said bottle-in gear unit, wherein said bottle-in gear unit comprises a worm gear having an outer spiral threaded portion and defining a plurality of feeding indentions thereat for orderly guiding outer surfaces of bottles at said feeding indentions in a sequent manner when said worm gear is driven to rotate, wherein an outlet end of said bottle-in transfer gear unit is operatively linked with an inlet end of said bottle-in transfer wheel unit.

9. The large transfusion filling and corking machine, as in claim 1, wherein said following and filling unit comprises a swing arm shaft retained at a base panel, wherein a swing arm is operatively coupled with said swing arm shaft and is operatively coupled with a following cam, wherein a cam shaft is coupled at said following cam, wherein one end of a connection arm is coupled with said swing arm via a swing shaft while another end of said connection arm is coupled with a directional guiding shaft to drive said directional guiding shaft to move at a swinging manner, wherein said directional guiding shaft is supported within a hollow shaft, wherein said hollow shaft has a bottom portion coupling with a gear wheel and an upper portion coupling with a following and filling feed-wheel, wherein a filling frame is coupled at an upper portion of said directional guiding shaft, wherein a filling head and a gas distributing box are coupled at said filling frame, wherein said filling head is operatively linked to said gas distributing box via a flexible tube.

10. The large transfusion filling and corking machine, as recited in claim 9, wherein said bottle-in unit, which is operatively linked to a bottle transferring unit, comprises a bottle-in gear unit, wherein said bottle transferring unit comprises an endless conveying belt and two fencing elements supported at two sides of said endless conveying belt, wherein an outlet end of said bottle transferring unit is connected to an inlet end of said bottle-in gear unit, wherein said bottle-in gear unit comprises a worm gear having an outer spiral threaded portion and defining a plurality of feeding indentions thereat for orderly guiding outer surfaces of bottles at said feeding indentions in a sequent manner when said worm gear is driven to rotate, wherein an outlet end of said bottle-in transfer gear unit is operatively linked with an inlet end of said bottle-in transfer wheel unit.

11. The large transfusion filling and corking machine, as in claim 1, wherein said nitrogen-charging and corking unit comprises a transmission shaft, wherein a bottom end portion of said transmission shaft is coupled with a transmission gear, while an upper end portion of said transmission shaft is coupled with a bottle supporting panel, wherein a nitrogen-charging and corking fence is supported and retained adjacent to said nitrogen-charging and corking feeding wheel, wherein a directional shaft is coaxially coupled within said transmission shaft, wherein a height adjustment shaft is coaxially coupled within said directional shaft, wherein a bottom end portion of said height adjustment shaft is coupled with an elevator assembly, while an upper end portion of said height adjustment shaft is coupled with an elevating cam, wherein said elevating cam is coupled with a machinery arm and a sealing sleeve, wherein each of said machinery arm and said sealing sleeve has an elevating cam-groove, wherein a first bearing is coupled with an upper connecting member within said elevating cam-groove of said sealing sleeve, wherein a bottle cap seat is coupled with said upper connecting member, wherein a cam sleeve is rotatably coupled on top of said bottle cap seat, wherein said sealing sleeve is coupled with said cam sleeve via a pressuring sleeve, wherein a vacuum adapter head is coupled with said bottle cap seat to operatively link with a vacuum distributing box, wherein a nitrogen gas adapter head is coupled with said cam sleeve to operatively link with a nitrogen gas distributing box.

12. The large transfusion filling and corking machine, as recited in claim 11, wherein a second bearing is coupled with a lower connecting member within said elevating cam-groove of said machinery arm, wherein said lower connecting member is coupled with an elevation shaft, wherein said machinery arm is operatively coupled at a bottom end portion of said elevation shaft, wherein a vacuum corking adapter head is operatively coupled at an upper end portion of said elevation shaft, wherein said vacuum corking adapter head is operatively linked to a vacuum corking electromagnetic valve via a flexible tube, wherein another outlet of said vacuum corking electromagnetic valve is operatively linked to said vacuum distributing box via another flexible tube.

13. The large transfusion filling and corking machine, as recited in claim 12, wherein said bottle-in unit, which is operatively linked to a bottle transferring unit, comprises a bottle-in gear unit, wherein said bottle transferring unit comprises an endless conveying belt and two fencing elements supported at two sides of said endless conveying belt, wherein an outlet end of said bottle transferring unit is connected to an inlet end of said bottle-in gear unit, wherein said bottle-in gear unit comprises a worm gear having an outer spiral threaded portion and defining a plurality of feeding indentions thereat for orderly guiding outer surfaces of bottles at said feeding indentions in a sequent manner when said worm gear is driven to rotate, wherein an outlet end of said bottle-in transfer gear unit is operatively linked with an inlet end of said bottle-in transfer wheel unit.

14. The large transfusion filling and corking machine, as in claim 1, wherein said bottle-in unit, which is operatively linked to a bottle transferring unit, comprises a bottle-in gear unit, wherein said bottle transferring unit comprises an endless conveying belt and two fencing elements supported at two sides of said endless conveying belt, wherein an outlet end of said bottle transferring unit is connected to an inlet end of said bottle-in gear unit, wherein said bottle-in gear unit comprises a worm gear having an outer spiral threaded portion and defining a plurality of feeding indentions thereat for orderly guiding outer surfaces of bottles at said feeding indentions in a sequent manner when said worm gear is driven to rotate, wherein an outlet end of said bottle-in transfer gear unit is operatively linked with an inlet end of said bottle-in transfer wheel unit.

15. A large transfusion filling and corking machine, comprising a frame unit, an electric control unit, a bottle-in unit, a following and filling unit, a nitrogen-charging and corking unit, and a bottle-out transfer wheel unit, wherein said bottle-in unit, said following and filling unit, said nitrogen-charging and corking unit, and said bottle-out transfer wheel unit are orderly supported by said frame unit, wherein said nitrogen-charging and corking unit is operatively linked to a cork-delivering unit, wherein a nitrogen-precharging unit is operatively linked between said bottle-in unit and said following and filling unit, wherein said nitrogen-precharging unit is operatively linked to said bottle-in unit through a bottle-in transfer wheel unit thereof, wherein said nitrogen-precharging unit is operatively linked to said following and filling unit through a transitional transfer wheel unit, wherein said following and filling unit comprises a swing arm shaft retained at a base panel, wherein a swing arm is operatively coupled with said swing arm shaft and is operatively coupled with a following cam, wherein a cam shaft is coupled at said following cam, wherein one end of a connection arm is coupled with said swing arm via a, swing shaft while another end of said connection arm is coupled with a directional guiding shaft to drive said directional guiding shaft to move at a swinging manner, wherein said directional guiding shaft is supported within a hollow shaft, wherein said hollow shaft has a bottom portion coupling with a gear wheel and an upper portion coupling with a following and filling feed-wheel, wherein a filling frame is coupled at an upper portion of said directional guiding shaft, wherein a filling head and a gas distributing box are coupled at said filling frame, wherein said filling head is operatively linked to said gas distributing box via a flexible tube.

16. The large transfusion filling and corking machine, as recited in claim 15, wherein said bottle-in unit, which is operatively linked to a bottle transferring unit, comprises a bottle-in gear unit, wherein said bottle transferring unit comprises an endless conveying belt and two fencing elements supported at two sides of said endless conveying belt, wherein an outlet end of said bottle transferring unit is connected to an inlet end of said bottle-in gear unit, wherein said bottle-in gear unit comprises a worm gear having an outer spiral threaded portion and defining a plurality of feeding indentions thereat for orderly guiding outer surfaces of bottles at said feeding indentions in a sequent manner when said worm gear is driven to rotate, wherein an outlet end of said bottle-in transfer gear unit is operatively linked with an inlet end of said bottle-in transfer wheel unit.

17. A large transfusion filling and corking machine, comprising a frame unit, an electric control unit, a bottle-in unit, a following and filling unit, a nitrogen-charging and corking unit, and a bottle-out transfer wheel unit, wherein said bottle-in unit, said following and filling unit, said nitrogen-charging and corking unit, and said bottle-out transfer wheel unit are orderly supported by said frame unit, wherein said nitrogen-charging and corking unit is operatively linked to a cork-delivering unit, wherein a nitrogen-precharging unit is operatively linked between said bottle-in unit and said following and filling unit, wherein said nitrogen-precharging unit is operatively linked to said bottle-in unit through a bottle-in transfer wheel unit thereof, wherein said nitrogen-precharging unit is operatively linked to said following and filling unit through a transitional transfer wheel unit, wherein said nitrogen-charging and corking unit comprises a transmission shaft, wherein a bottom end portion of said transmission shaft is coupled with a transmission gear, while an upper end portion of said transmission shaft is coupled with a bottle supporting panel, wherein a nitrogen-charging and corking fence is supported and retained adjacent to said nitrogen-charging and corking feeding wheel, wherein a directional shaft is coaxially coupled within said transmission shaft, wherein a height adjustment shaft is coaxially coupled within said directional shaft, wherein a bottom end portion of said height adjustment shaft is coupled with an elevator assembly, while an upper end portion of said height adjustment shaft is coupled with an elevating cam, wherein said elevating cam is coupled with a machinery arm and a sealing sleeve, wherein each of said machinery arm and said sealing sleeve has an elevating cam-groove, wherein a first bearing is coupled with an upper connecting member within said elevating cam-groove of said sealing sleeve, wherein a bottle cap seat is coupled with said upper connecting member, wherein a cam sleeve is rotatably coupled on top of said bottle cap seat, wherein said sealing sleeve is coupled with said cam sleeve via a pressuring sleeve, wherein a vacuum adapter head is coupled with said bottle cap seat to operatively link with a vacuum distributing box, wherein a nitrogen gas adapter head is coupled with said cam sleeve to operatively link with a nitrogen gas distributing box.

18. The large transfusion filling and corking machine, as recited in claim 17, wherein a second bearing is coupled with a lower connecting member within said elevating cam-groove of said machinery arm, wherein said lower connecting member is coupled with an elevation shaft, wherein said machinery arm is operatively coupled at a bottom end portion of said elevation shaft, wherein a vacuum corking adapter head is operatively coupled at an upper end portion of said elevation shaft, wherein said vacuum corking adapter head is operatively linked to a vacuum corking electromagnetic valve via a flexible tube, wherein another outlet of said vacuum corking electromagnetic valve is operatively linked to said vacuum distributing box via another flexible tube.

19. The large transfusion filling and corking machine, as recited in claim 18, wherein said bottle-in unit, which is operatively linked to a bottle transferring unit, comprises a bottle-in gear unit, wherein said bottle transferring unit comprises an endless conveying belt and two fencing elements supported at two sides of said endless conveying belt, wherein an outlet end of said bottle transferring unit is connected to an inlet end of said bottle-in gear unit, wherein said bottle-in gear unit comprises a worm gear having an outer spiral threaded portion and defining a plurality of feeding indentions thereat for orderly guiding outer surfaces of bottles at said feeding indentions in a sequent manner when said worm gear is driven to rotate, wherein an outlet end of said bottle-in transfer gear unit is operatively linked with an inlet end of said bottle-in transfer wheel unit.

* * * * *